US005786741A

United States Patent [19]

Leibzon

[11] Patent Number: 5,786,741

[45] Date of Patent: Jul. 28, 1998

[54] POLYGON MAGNET STRUCTURE FOR VOICE COIL ACTUATOR

[75] Inventor: Emanuel Leibzon, Tarzana, Calif.

[73] Assignee: Aura Systems, Inc., El Segundo, Calif.

[21] Appl. No.: 576,801

[22] Filed: Dec. 21, 1995

[51] Int. Cl.[6] ..... H01F 7/08; H04R 25/00

[52] U.S. Cl. ..... 335/222; 335/296; 335/306; 381/199; 381/201

[58] Field of Search ..... 335/302–306, 335/222, 223, 296; 381/199, 200, 201

[56] References Cited

U.S. PATENT DOCUMENTS

| | | | |
|---|---|---|---|
| 1,834,995 | 12/1931 | Bathrick | 381/199 |
| 2,275,880 | 3/1942 | Arey | 381/199 |
| 3,009,360 | 11/1961 | Morsewich | 74/5 R |
| 3,237,059 | 2/1966 | Meyerer | 335/306 |
| 3,240,075 | 3/1966 | Ranes | 74/5.5 |
| 4,013,846 | 3/1977 | Krawczak et al. | 179/115.5 |
| 4,334,127 | 6/1982 | Shimada et al. | 179/115.5 |
| 4,881,984 | 11/1989 | Chandhok et al. | 148/101 |
| 4,998,976 | 3/1991 | Rappaport | 128/653 |
| 5,063,934 | 11/1991 | Rappaport et al. | 128/653.5 |
| 5,287,084 | 2/1994 | Sone | 340/388.4 |
| 5,320,103 | 6/1994 | Rappaport et al. | 128/653.5 |
| 5,576,679 | 11/1996 | Ohashi et al. | 335/306 |

*Primary Examiner*—Cassandra Spyrou
*Assistant Examiner*—Raymond Barrera
*Attorney, Agent, or Firm*—Kathy Mojibi

[57] ABSTRACT

A voice coil actuator is disclosed having a housing, a pole piece, a magnet structure and a coil. The housing is cylindrical and defines a vertical axis. The housing further defines a base portion, an outer wall extending axially from the base portion and a top plate extending radially inward from the outer wall. The base portion defines an annular channel coaxial within the base portion. The pole piece is coaxially disposed within the housing. A gap is defined between the top plate and the pole piece. The coil is moveably suspended coaxially within the gap. The magnet structure is fabricated from rectangular shaped radially magnetized permanent magnets. The magnets are arranged in a polygonal shape and disposed in the channel.

5 Claims, 1 Drawing Sheet

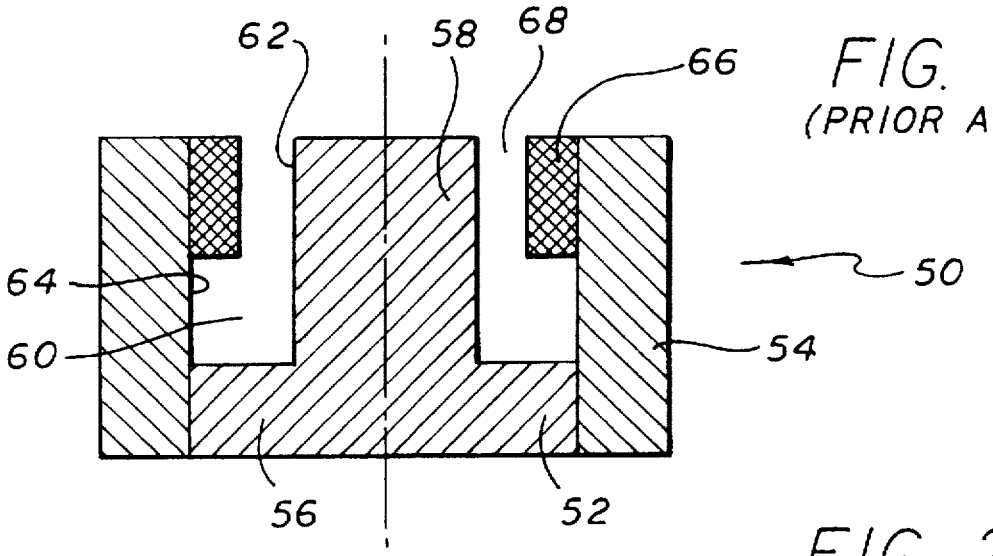
FIG. 1
(PRIOR ART)
FIG. 2
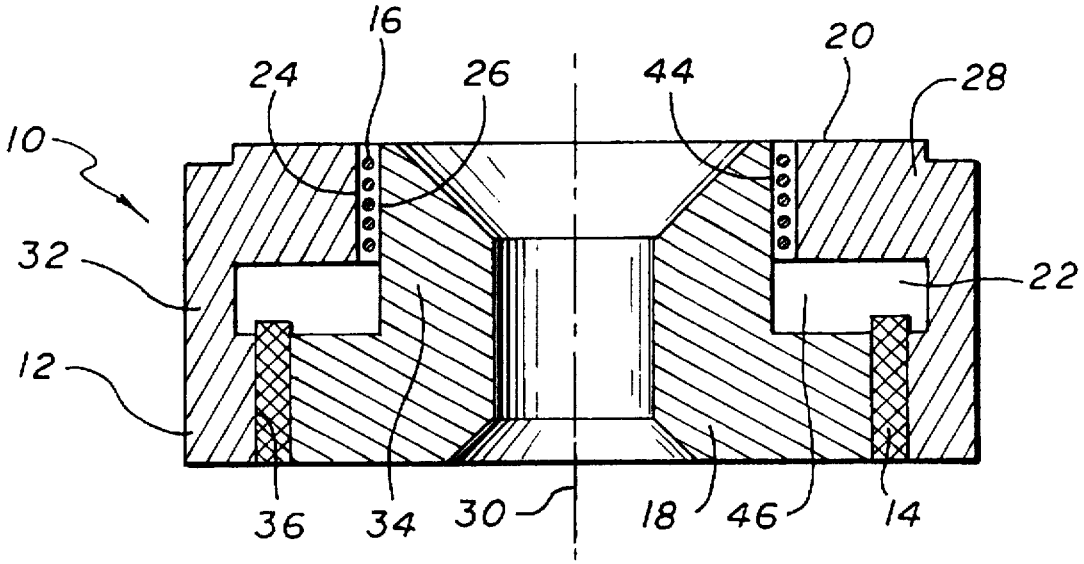
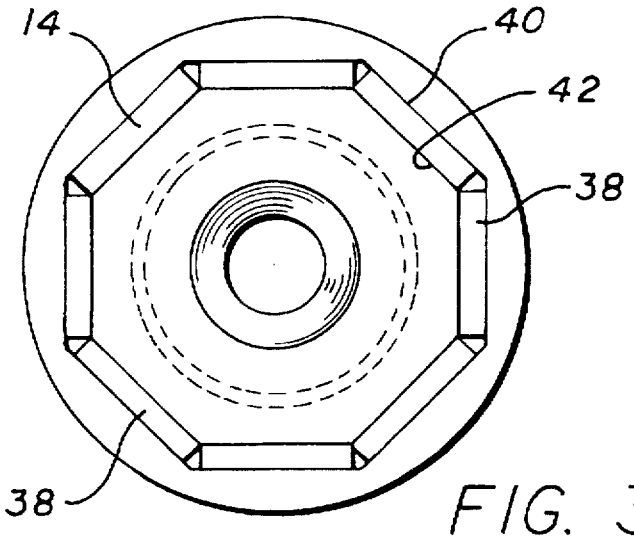
FIG. 3
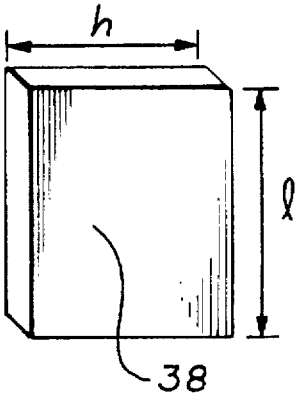
FIG. 4

POLYGON MAGNET STRUCTURE FOR VOICE COIL ACTUATOR

FIELD OF THE INVENTION

The present invention relates generally to electromagnetic voice coil actuators and more particularly to an electromagnetic voice coil actuator having a novel magnetic structure.

BACKGROUND OF THE INVENTION

Several types of voice coil actuators are known. Some of these voice coil actuators utilize cylindrical radially polarized ring magnets. Referring to FIG. 1, these voice coil actuators 50 typically include a cylindrical housing 52 having an outer cylindrical portion 54, a base portion 56 and a pole piece 58. The housing further defines a chamber 60 defining an inner wall 62 and an outer wall 64. The pole piece is adjacent the inner wall. By way of example, in one of the known voice coil actuators, shown in FIG. 1, the cylindrical ring magnet 66 is disposed adjacent the outer wall of the housing chamber, in a gap 68 between the housing outer cylindrical portion and the pole piece. In another embodiment, the cylindrical ring is disposed in a channel in the base portion of the housing. In another embodiment, the cylindrical magnet is disposed in the outer cylindrical portion of the housing. In yet another embodiment, the magnetic structure is comprised of a magnetic slug and is disposed in the pole piece.

It is desirable in a voice coil actuator to have an efficient actuator that generates maximum flux density uniformly along the height of the gap between the housing and the pole piece. It is also desirable to have a voice coil actuator design with high structural integrity. Another goal in the design of a voice coil actuator is to simplify the manufacturing and assembly process so as to allow the voice coil actuators to be manufactured as inexpensively as possible.

A problem with all of these voice coil actuators arises in the cost of manufacturing. This problem is created by the fact that the cylindrical magnet is a solid annular piece. Therefore, different sizes of voice coil actuators require different sizes of cylindrical magnets. As a result, the cylindrical magnets are expensive to manufacture. It is therefore desirable to have a voice coil actuator that generates maximum flux density uniformly along the height of the gap, has structural integrity, and is inexpensive to manufacture. It is further desirable to have a voice coil actuator design wherein different sizes of voice coil actuators may use the same standardized magnetic element.

SUMMARY OF THE INVENTION

It is therefore an object of the present invention to provide a novel voice coil actuator which generates maximum flux density uniformly along the height of the gap. It is another object of the present invention to provide a novel voice coil actuator which is easily and inexpensively manufactured. It is a further object of the invention to provide a novel voice coil actuator having a magnet configuration with standardized magnet segments.

According to the present invention, a novel voice coil actuator includes a housing, a pole piece, a magnet structure and a coil. The housing is cylindrical and defines a vertical axis. The housing further defines a base portion, an outer wall extending axially from the base portion and a top plate extending radially inward from the outer wall. The base portion defines an annular channel coaxial within the base portion. The pole piece is coaxially disposed within the housing. A gap is defined between the top plate and the pole piece. The coil is moveably suspended coaxially within the gap. The magnet structure is fabricated from rectangular shaped radially magnetized permanent magnet segments. The magnet segments are arranged in a polygonal shape and disposed in the channel.

It is a feature of the present invention that different quantities of the standardized magnet segments may be used to create the magnetic structure for various sizes of voice coil actuators.

These and other objects, advantages and features of the present invention will become readily apparent to those skilled in the art from a study of the following Description of an Exemplary Preferred Embodiment when read in conjunction with the attached Drawing and appended Claims.

BRIEF DESCRIPTION OF THE DRAWING

FIG. 1 (PRIOR ART) is a front cross sectional view of a known voice coil actuator;

FIG. 2 is a cross section of the novel voice coil actuator of the present invention;

FIG. 3 is a cross-sectional top view of the novel voice coil actuator of the present invention; and FIG. 4 is a perspective view of a magnet segment used in the novel voice coil actuator of the present invention.

DESCRIPTION OF AN EXEMPLARY PREFERRED EMBODIMENT

Referring now to FIG. 2 there is shown a novel voice coil actuator 10 constructed according to the principles of the present invention. The actuator 10 includes a housing 12, a magnet structure 14 and an electrical current conductive coil 16.

The housing 12 is preferably cylindrical and has a base portion 18 at one end and a first surface 20 at an opposing end of the housing. A continuous chamber 22 is disposed in the first surface 20. The chamber 22 has an outer first wall 24 and an inner second opposing wall 26. In the embodiment shown, the inner wall 26 extends from the first surface 20 to the base portion 18. The housing 12 further includes a top plate 28 extending radially inward from the outer first wall 24 and adjacent the first surface 20.

Alternatively, the housing 12 may be described as being cylindrical, defining a vertical axis 30, and having a cylindrical outer portion 32, the base portion 18, the outer wall 24 extending axially from the base portion 18 and the top plate 28 extending radially inward from the outer wall 24. A pole piece 34 is coaxially disposed within the cylindrical portion 32.

The housing 12 further includes a magnet channel 36 defined in the base portion 18. The magnet channel 36 is preferably annular in shape and is disposed intermediate the chamber outer wall 24 and inner wall 26. The magnet structure 14 is disposed in the magnet channel 36. The magnet structure 14 is constructed from a plurality of segments 38 of radially polarized magnetic material. Accordingly, each of the magnet segments 38 has a first face 40 of a first magnetic polarity proximal the chamber outer first wall 24 and a second face 42 of a second, opposite magnetic polarity proximal the chamber inner second wall 26. In the embodiment shown, the north pole is proximal the outer first wall and the south pole is proximal the inner second wall.

The magnet segments 38 are each preferably rectangular shaped, as best shown in FIG. 4. The magnet segments are arranged in the magnet channel 36 in a polygon arrangement. The number of magnet segments used in the voice coil actuators is dependent upon the size of the voice coil actuator. The number of magnet segments may preferably vary from four to thirty-six magnet segments.

The magnet segments 38 are preferably manufactured in the same standardized dimensions. As a result, the larger voice coil actuators will require more magnet segments and the smaller voice coil actuators will require less magnet segments. By way of example, six magnet segments may be formed in a hexagon shape to form the magnet structure for a ¾ inch voice coil actuator, while eight magnet segments may be formed in an octagon shape to form a magnet structure for a one inch voice coil actuator. The use of standardized magnet segments allows for a considerably less expensive manufacturing cost for the magnets and the voice coil actuators.

A first gap 44 is defined between the pole piece 34 and the top plate 28. A second gap 46 is defined between the chamber inner wall 26 and outer wall 24. As seen in FIG. 2, the first gap 44 is narrower than the second gap 46.

The coil 16 is moveably suspended in the first gap 44 such that an electrical current in the coil develops a magnetic force on the coil in a direction substantially normal to the radial magnetic flux to displace the coil 16 in response to such magnetic force. Of course, when the coil is coaxially suspended in the first gap 44, the force will be axial and linearly proportional to the current, as is well known. It is known by various means to suspend the coil. Two particular arrangements will be described hereinbelow.

As best seen in FIG. 2, the length of the coil 16 in the embodiment shown is less than the height of the first gap 44. Accordingly, the above described actuator is of a short coil design. The actuator may also be constructed as a long coil actuator having a coil that is longer than the height of the first gap. Either the short coil or long coil designs can be used with the present invention.

The housing 12 and pole piece 34 of the voice coil actuator are preferably fabricated from a ferromagnetic material, such as low carbon steel. The top plate 28 is preferably fabricated from steel.

As previously discussed, it is desirable for a voice coil actuator design to be efficient. The embodiment shown in FIG. 2 generates linear flux distribution in the first gap, and is therefore efficient. Moreover, the design allows the number of magnet segments to be increased without increasing the thickness of the magnet. As a result, the reluctance of the circuit is not also increased when the number of magnet segments is increased. The voice coil actuator design may be used with any high energy magnets, including rare earth neodymium magnets.

The present voice coil actuator design also allows for a flexible first gap 44 height. Therefore, the height of the top plate 28 may be modified to allow the flux to be focused or defocused as desired.

The present design also is structurally reliable. The magnet structure 14 is disposed at a sufficient distance from the high temperature coil 16. Also, the magnet structure 14 is structurally locked between the housing 12 and the pole piece 34. These features both serve to provide a structurally reliable voice coil actuator.

There has been described hereinabove an exemplary preferred embodiment of a novel voice coil actuator. Those skilled in the art may now make numerous uses of and departures from the above described inventive concepts without departing from the inventive concepts disclosed herein. Accordingly, the present invention is to be defined solely by the scope of the following claims.

I claim:

1. A voice coil actuator comprising:

a cylindrical housing defining a vertical axis and having an outer wall, a base portion extending radially in from one end of said outer wall and a top plate extending radially in from another end of said outer wall, said base portion and said top plate further defining an annular channel coaxial within said housing;

a pole piece coaxially disposed within said housing and being dimensioned wherein a first gap is defined between said top plate and said pole piece and a second gap is defined between said base portion and said pole piece, said annular channel being disposed intermediate said first gap and said second gap;

a plurality of rectangular permanent magnets disposed in said second gap and having a first pole face disposed adjacent said base portion and a second pole face disposed adjacent said pole piece, said first pole face and said second pole face being radially oriented with respect to said axis, said magnets being arranged in a polygonal shape such that each of said magnets is disposed interstitially adjacent in intimate contact with two other of said magnets and an electrical current conductive coil movably suspended coaxially within said first gap such that an electrical current is said coil develops an axial magnetic force on said coil.

2. A voice coil actuator in accordance with claim 1 wherein said channel is disposed intermediate said pole piece and said outer wall.

3. A voice coil actuator in accordance with claim 1 wherein said plurality of magnets is comprised of four to thirty-six magnets.

4. A voice coil actuator in accordance with claim 1 wherein each of said plurality of magnets are in the form of rectangular blocks.

5. A voice coil actuator as set forth in claim 1 wherein said coil has an axial length less than a height of said first gap such that said coil is disposed fully in said first gap in the range of a total stroke of said coil.

* * * * *